US006468167B1

(12) United States Patent
Florian

(10) Patent No.: US 6,468,167 B1
(45) Date of Patent: Oct. 22, 2002

(54) GOLF PRACTICE MAT

(76) Inventor: Raymond J. Florian, 14440 Elwell, Belleville, MI (US) 48111

( * ) Notice: Subject to any disclaimer, the term of this patent is extended or adjusted under 35 U.S.C. 154(b) by 0 days.

(21) Appl. No.: 09/943,298

(22) Filed: Aug. 31, 2001

(51) Int. Cl.[7] ..... A63B 69/36
(52) U.S. Cl. ..... 473/278; 473/266
(58) Field of Search ..... 473/278, 261, 473/264, 265, 266, 162, 218

(56) References Cited

U.S. PATENT DOCUMENTS

| | | | | | |
|---|---|---|---|---|---|
| 3,870,315 | A | | 3/1975 | Lawlor et al. | |
| 3,992,013 | A | * | 11/1976 | Golden | 473/409 |
| 4,248,431 | A | * | 2/1981 | Burnes | 473/270 |
| 4,311,312 | A | * | 1/1982 | O'Brien | 473/218 |
| 4,786,057 | A | | 11/1988 | Brown | |
| 4,962,933 | A | | 10/1990 | Awazu et al. | |
| 5,520,391 | A | | 5/1996 | Howe | |
| 5,954,592 | A | * | 9/1999 | Laffer et al. | 473/220 |
| 6,001,026 | A | | 12/1999 | Breneman | |

* cited by examiner

*Primary Examiner*—Paul T. Sewell
*Assistant Examiner*—M. Chambers
(74) *Attorney, Agent, or Firm*—Charles W. Chandler

(57) ABSTRACT

A golf swing apparatus and method for improving a golfer's backstroke and powerstroke includes a mat on which a practice ball is mounted, a target located on one side of the golf ball location and a second target located on the opposite side of the golf ball location, the two targets and the golf ball location being aligned with a desired club powerswing motion. The club handle has a laser light which when the club is raised on the backswing, focus is on the first target, when the club is raised on completion of the powerstroke, the laser light focuses on the second target.

5 Claims, 4 Drawing Sheets

GOLF PRACTICE MAT

BACKGROUND AND SUMMARY OF THE INVENTION

Many devices are used for assisting a golfer in perfecting his golf swing. Examples of such prior art include U.S. Pat. No. 6,001,026 issued Dec. 14, 1999 to Fred E. Breneman for "Golf Training Device"; U.S. Pat. No. 5,520,391 issued May 28, 1996 to Brian G. Howe for "Golf Backswing Training Device"; U.S. Pat. No. 4,962,933 issued Oct. 16, 1990 to Toshifumi Awazu and Hiroshi Awazu for "Golf Swing Practice Device"; U.S. Pat. No. 4,786,057 issued Nov. 22, 1988 to Larry G. Brown for "Golf Swing Training Device"; and U.S. Pat. No. 3,870,315 issued Mar. 11, 1975 to Robert E. Lawlor et al. for "Golf Swing Training Device"

A proper golf swing requires that the golfer swing the head of the club along a desired path of motion for the club to properly contact the ball. To achieve this swing, during the course of the backswing the club must follow a path of motion a desired height above the ground.

The prior art shows what is known as a backswing indicator or a flipper so that the golfer can tell whether his club is at a proper height above the ground on the backswing.

Further, as he raises the club in his backswing, the handle will be aligned with the ground surface. Upon completion of the power stroke, the handle will pass through a position in which the club is above the handle, and the head of the handle will be aligned with another imaging point on the ground.

I have found that a full golf swing can be improved by locating a target on the ground a predetermined distance along the path of motion of the head, before it contacts the ball. A second target is also located along the head's path of motion after it strikes the ball. In each case, during the course of the power swing the handle end of the shaft will be aligned, with the first target on the backswing, and then with the second target upon completion of the power stroke.

I have found that if the shaft axis passes through both targets as the head moves through its stroke, the power swing is improved.

Preferably, I employ a laser light in the handle. As the club head is raised in either the backswing or at the completion of the power stroke, the laser light illuminate both targets. If the light misses one or both targets, then the user adjusts his stroke accordingly.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views and in which:

FIGS. 3 and 4 are intended to illustrate how the club handle is aligned with the target, and not to suggest the proper form for a golf swing;

DESCRIPTION OF THE PREFERRED EMBODIMENTS

Figure 1:
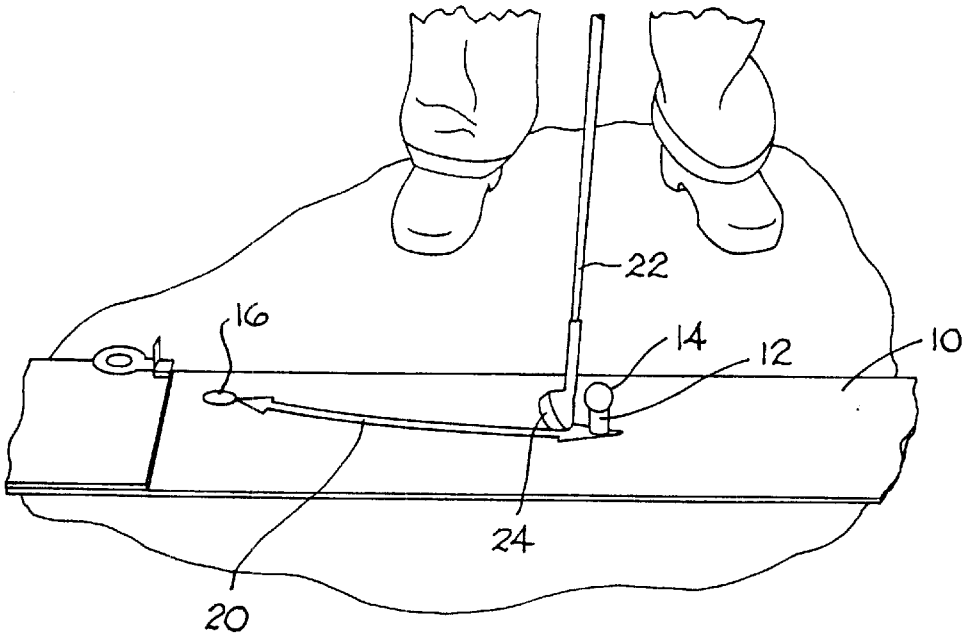
FIG. 1 is a view illustrating the club head being aligned with a ball on a practice mat.

Referring to the drawings, FIGS. 1–4 illustrate an elongated artificial grass practice golf mat 10, which may be of the type illustrated in my U.S. Pat. No. 6,156,396 issued Dec. 5, 2000, for "Golf Practice Mat". A ball-supporting structure in the form of a resilient tubular tee 12 is mounted in a central position on the mat. Preferably, tee 12 is a rubber-like material, approximately ⅝" in diameter and disposed about 1" above the surface of the mat.

A ball 14 is illustrated mounted on tee 12. For illustrative purposes, a first target 16 and a second target 18 are disposed on the mat on opposite sides of the tee. Each target is about 1½ in diameter. Each target is about 16" from the tee. Preferably, a line 20 is marked on the mat indicating the desired ground tracing of a golf club head as it approaches the golf ball.

Figure 5:
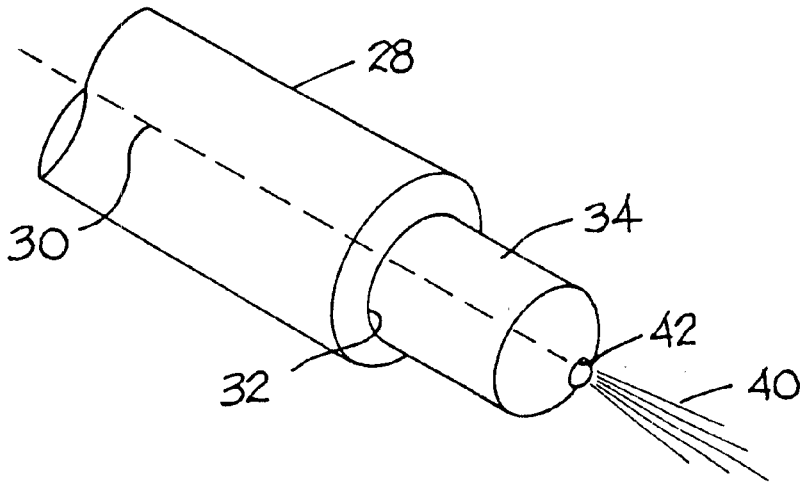
FIG. 5 is an enlarged view of the handle showing the laser light.
Figure 6:
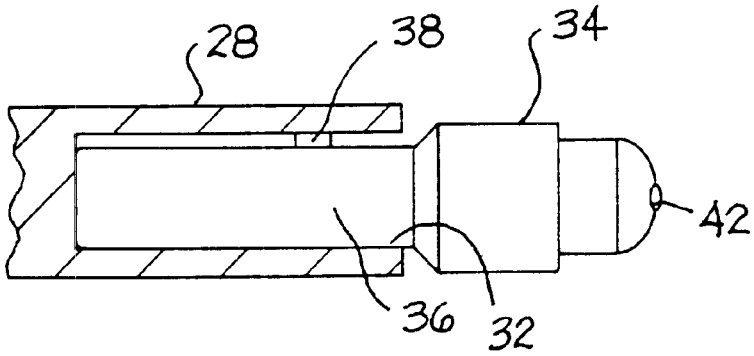
FIG. 6 is a sectional view of the handle showing the laser light positioned in the handle.

The apparatus further includes a practice club 22. Club 22 has a club head 24, an elongated shaft 26 and a handle 28. The club head and shaft are conventional, however, referring to FIG. 5, note that the handle is mounted along a shaft axis 30.

The end of the handle has an opening 32. A conventional battery powered laser light 34 is disposed in opening 32. The laser light has a body 36 inserted in the handle opening with a switch 38 that is depressed by the internal wall of handle opening to the laser light. As is well known, a laser light emits a very focused beam 40, that is, the beam does not appreciably spread from the source of the beam to the location on which the beam is focused. In this case the beam is red and is emitted through an opening 42. The laser light is mounted so that the beam is directed along shaft axis 30.

Figure 3:
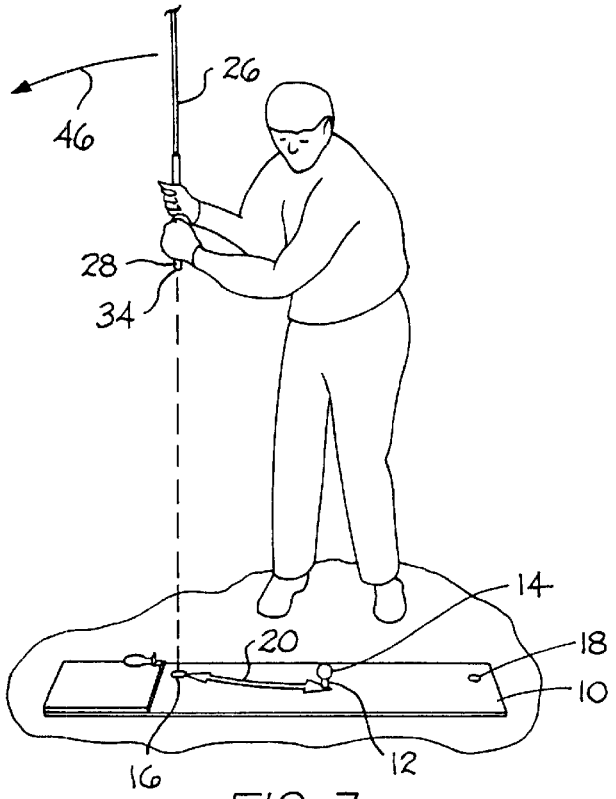
FIG. 3 illustrates the club handle aligned with the first target.
Figure 4:
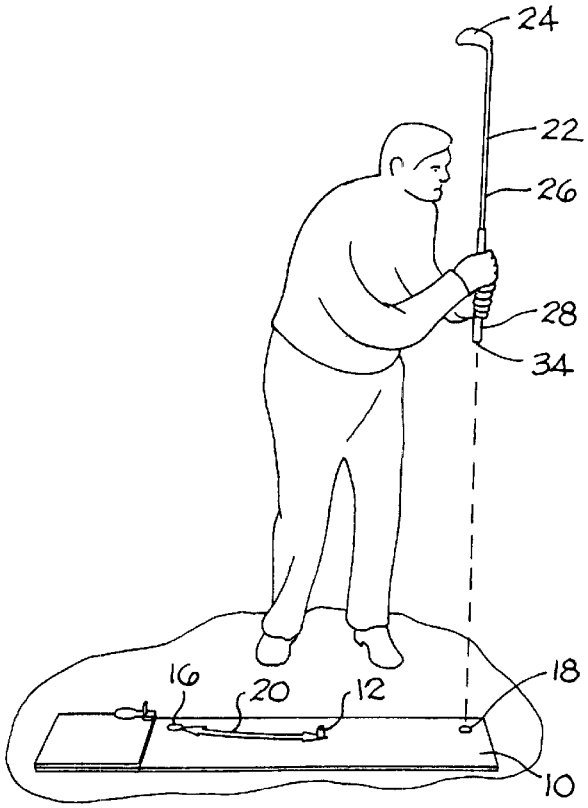
FIG. 4 illustrates the club handle aligned with the second target.

In use, FIG. 1 illustrates a user positioning club head 14 slightly rearwardly of ball 12. The user commences his backswing in the direction of arrow 44 by raising the club head and shaft, as illustrated in FIG. 3. At this point, the user commences his forward stroke in the opposite direction, in the direction of arrow 46. The club handle is moved such that laser light 34 directs its beam along the ground to a position in which the beam is aligned with the first target 16. The user swings the club head to strike the ball. Upon completion of the powerstroke, the laser light beam is intended to pass along a path on the ground in which it is aligned with the second target 18. If the user employs a proper swing, the laser light will pass along a ground path in which it is aligned with both targets. If he misses one of the targets, he can then make an appropriate adjustment either with the placement of his hands or feet to correct his swing.

Figure 2:
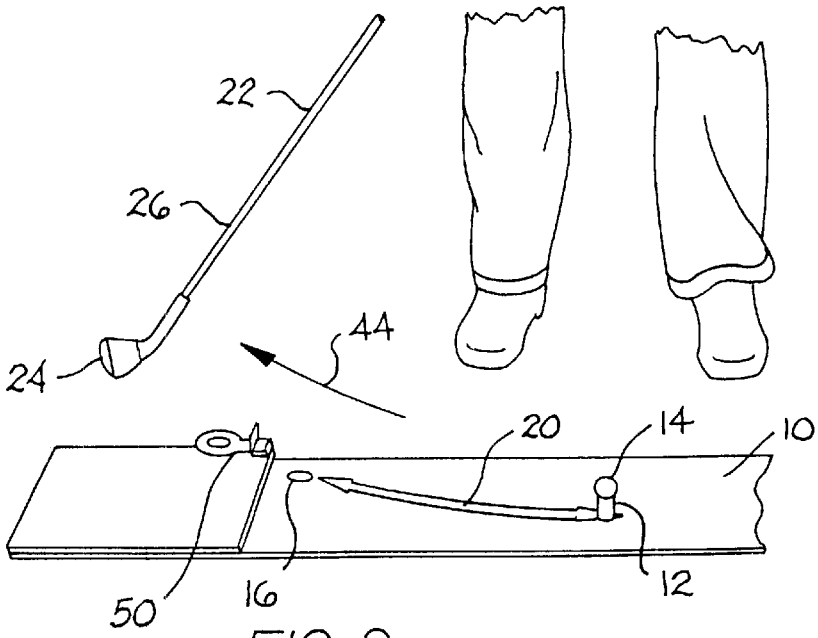
FIG. 2 illustrates the club head being raised in a back swing in preparation for a power stroke.

To further assist in perfecting his backswing, a backswing indicator or a flipper 50 is mounted along the backswing path as illustrated in FIG. 2. The club head may either strike or miss the flipper.

Figure 7:
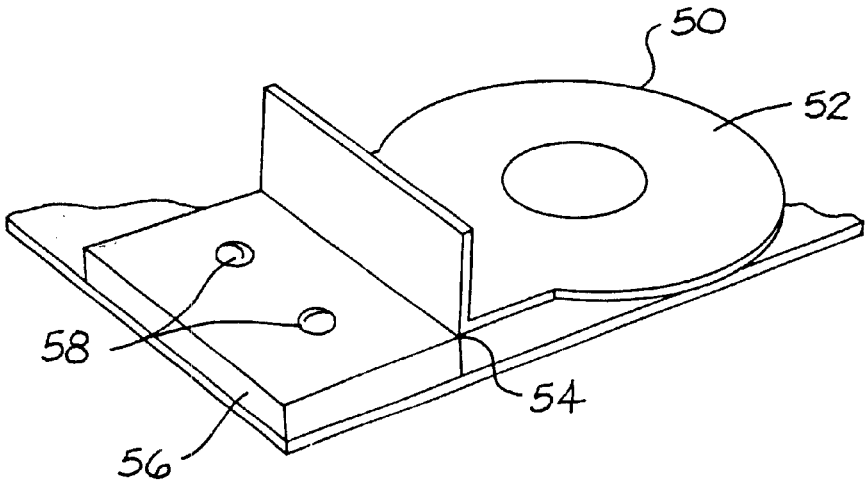
FIGS. 7 and 8 show the backstroke flipper in its lower and raised positions.
Figure 8:
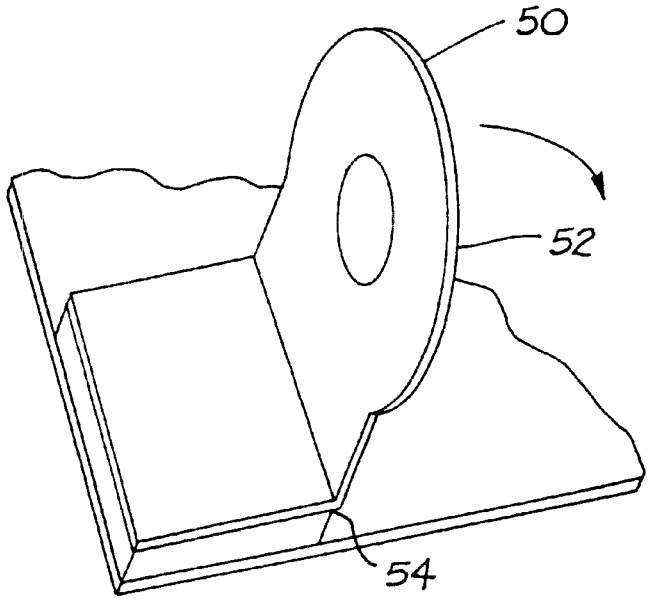

FIGS. 7 and 8 illustrate flipper 90 that basically comprises a relatively plastic stiff head 52 attached by a fabric hinge 54 to a stiff plastic base 56 by fastener members 58. The arrangement is such that, as viewed in FIG. 8, the flipper head 52 is disposed in an upright position. As the user commences his backswing, in an appropriate distance above the ground, the club head will strike the flipper head causing it to pivot to a generally horizontal position, as illustrated in FIG. 7. If the user misses the flipper, he can then make an appropriate adjustment in his backswing.

It is to be understood that although ball 14 is illustrated as a commercially available product, various forms of practice balls can be used, such as a rolled up piece of paper wrapped in masking tape.

Having described my invention, I claim:

1. A golf swing practice apparatus, comprising:

a mat adapted to be placed on a ground surface;

a golf ball supporting structure mounted on the mat;

a golf club having a head, a shaft and a handle disposed along a shaft axis;

a first target disposed on the mat on one side of the golf ball supporting structure along the path of motion of a backswing;

a second target disposed on the mat on the opposite side of the golf ball supporting structure along the path of a desired golf swing;

the club being movable in a swing, in which the shaft axis is aligned with the first target, then the club head strikes the golf ball in a power stroke, and then the shaft axis is aligned with the second target; and a backswing indicator mounted on the mat to be moveable from an upright position toward a lower position when the indicator is struck by the club head during a backswing motion to indicate to a user whether or not the club head is being moved at a proper height from the mat.

2. Apparatus as defined in claim 1, including visual alignment means carried on the golf club for indicating the position of the club with respect to said first and second targets.

3. Apparatus as defined in claim 2, in which the visual alignment means comprises a laser light carried on the club to focus a beam on the first and second targets as the golf club is raised above the handle upon either initiating or completing a power stroke.

4. Apparatus as defined in claim 1, in which the backswing indicator comprises a flipper member mounted on the mat so as to be movable between an upright position and lower position, and means pivotally connecting the flipper member to the mat is a position to be struck by a golf club being swung in a backstroke.

5. Apparatus as defined in claim 1, in which the mat comprises an artificial grass carpet.

* * * * *